US011404805B2

(12) United States Patent
Borodin et al.

(10) Patent No.: US 11,404,805 B2
(45) Date of Patent: Aug. 2, 2022

(54) SOLDERLESS CIRCUIT CONNECTOR

(71) Applicant: THE RESEARCH FOUNDATION FOR THE STATE UNIVERSITY OF NEW YORK, Albany, NY (US)

(72) Inventors: Anatoliy Borodin, Setauket, NY (US); Yuri Polyakov, East Setauket, NY (US)

(73) Assignee: The Research Foundation for The State University of New York, Albany, NY (US)

( * ) Notice: Subject to any disclaimer, the term of this patent is extended or adjusted under 35 U.S.C. 154(b) by 0 days.

(21) Appl. No.: 17/073,869

(22) Filed: Oct. 19, 2020

(65) Prior Publication Data

US 2021/0036446 A1 Feb. 4, 2021

Related U.S. Application Data

(63) Continuation of application No. PCT/US2019/028257, filed on Apr. 19, 2019.

(60) Provisional application No. 62/660,036, filed on Apr. 19, 2018.

(51) Int. Cl.

| | |
|---|---|
| ***H01R 12/70*** | (2011.01) |
| ***H01R 12/71*** | (2011.01) |
| ***H01R 13/24*** | (2006.01) |

(52) U.S. Cl.

CPC ..... *H01R 12/7076* (2013.01); *H01R 12/714* (2013.01); *H01R 13/2442* (2013.01)

(58) Field of Classification Search

CPC ..... H01R 12/7076; H01R 12/714; H01R 13/2442

USPC ..... 439/81

See application file for complete search history.

(56) References Cited

U.S. PATENT DOCUMENTS

| | | | |
|---|---|---|---|
| 4,427,249 | A | 1/1984 | Bright et al. |
| 4,548,451 | A | 10/1985 | Benarr et al. |
| 5,069,626 | A | 12/1991 | Patterson et al. |
| 5,441,690 | A | 8/1995 | Ayala-Esquilin et al. |
| 5,738,530 | A | 4/1998 | Schreiber et al. |
| 5,764,487 | A | 6/1998 | Natsume |

(Continued)

FOREIGN PATENT DOCUMENTS

| | | | |
|---|---|---|---|
| CN | 101924283 | A | 12/2010 |
| CN | 103682705 | A | 3/2014 |

(Continued)

OTHER PUBLICATIONS

International Search Report dated Aug. 9, 2019 issued in counterpart application No. PCT/US2019/028257, 3 pages.

(Continued)

*Primary Examiner* — Peter G Leigh

(74) *Attorney, Agent, or Firm* — The Farrell Law Firm, P.C.; John F. Gallagher, III, Esq.

(57) ABSTRACT

A device is provided that allows for repeated electrical connection of an integrated circuit. The device includes a top, an alignment plate, a connector and a bottom. The top, alignment plate, connector and bottom each have first and second sides facing opposite directions, with the top, alignment plate, connector and bottom being stacked in a vertical orientation. The top is vertically moveable relative to the alignment plate to secure the integrated circuit adjacent to an edge of the connector, with the edge extending from a space between the first and second sides thereof.

20 Claims, 9 Drawing Sheets

(56) References Cited

U.S. PATENT DOCUMENTS 6,350,138 B1 2/2002 Atobe et al.
6,431,876 B1 8/2002 Svenkeson et al.
6,477,058 B1 * 11/2002 Luebs ..... H05K 1/141 174/250
6,639,800 B1 * 10/2003 Eyman ..... H01L 23/4006 165/185
6,724,629 B1 4/2004 Augustin et al.
6,791,838 B1 * 9/2004 Hung ..... H01L 23/4006 165/185
6,911,816 B2 6/2005 Holt et al.
6,929,484 B2 * 8/2005 Weiss ..... H01R 13/2414 439/66
7,059,907 B2 6/2006 Winings et al.
7,074,068 B1 * 7/2006 Ma ..... H05K 7/1061 439/331
7,121,843 B2 10/2006 Byquist
7,171,742 B2 * 2/2007 Cromwell ..... H01L 23/4006 257/E23.084
7,232,101 B2 6/2007 Wanek et al.
7,323,358 B1 * 1/2008 Cromwell ..... H01L 23/4093 257/678
7,335,030 B2 * 2/2008 Kunioka ..... G01R 1/0433 324/754.08
7,539,027 B2 * 5/2009 Callahan ..... H05K 7/1061 361/783
7,632,128 B2 * 12/2009 Lin ..... H01L 23/32 439/331
7,805,786 B2 10/2010 Lambarth
8,251,712 B2 8/2012 Cheng
8,333,604 B2 * 12/2012 Wertz ..... H05K 7/1053 439/331
8,667,908 B2 3/2014 Martin et al.
8,693,200 B2 * 4/2014 Colgan ..... H01L 23/4093 361/702
9,134,387 B1 9/2015 Gajda et al.
9,894,767 B1 2/2018 Krugman
9,899,358 B2 2/2018 Tate et al.
10,008,797 B2 6/2018 Hassan-Ali et al.
10,015,902 B2 7/2018 Chen et al.
10,654,504 B1 5/2020 Lee et al.
10,654,616 B2 5/2020 Bradley et al.
10,741,950 B1 8/2020 Consoli et al.
10,974,750 B2 4/2021 Dooris et al.
11,006,523 B1 5/2021 Vinciarelli et al.
11,015,298 B2 5/2021 Sperling et al.
11,015,299 B2 5/2021 Sperling et al.
11,121,509 B2 9/2021 Wei et al.
2002/0081869 A1 6/2002 Abbott
2003/0036301 A1 * 2/2003 Colbert ..... H05K 7/1061 439/331
2005/0118004 A1 6/2005 Simpson et al.
2005/0128713 A1 * 6/2005 Schmidberger ..... H01L 23/4006 361/719
2006/0261623 A1 11/2006 Kuznarik
2007/0149025 A1 * 6/2007 Mori ..... H05K 3/325 439/331
2008/0136208 A1 6/2008 Kuznarik et al.
2008/0300713 A1 12/2008 Leith
2009/0093142 A1 4/2009 Lin et al.
2010/0053897 A1 * 3/2010 Kusaka ..... H01L 23/4006 361/697
2011/0014818 A1 1/2011 Carter et al.
2012/0074287 A1 3/2012 Wojatzki et al.
2012/0182705 A1 7/2012 Hardin
2012/0206903 A1 8/2012 Kang et al.
2013/0303003 A1 11/2013 Tsang et al.
2014/0160681 A1 6/2014 Chen
2015/0368059 A1 12/2015 Nakayama et al.
2015/0375579 A1 12/2015 Summers et al.
2016/0183402 A1 6/2016 Tamarkin et al.
2016/0229077 A1 8/2016 Olson et al.
2018/0334212 A1 11/2018 Bowers et al.
2019/0052008 A1 2/2019 Consoli et al.
2019/0084465 A1 3/2019 Kibler
2019/0103691 A1 4/2019 Sypolt et al.
2019/0275363 A1 9/2019 Jones et al.
2020/0004252 A1 1/2020 Aljallis et al.
2020/0084882 A1 3/2020 Neufeld
2020/0131713 A1 4/2020 Sperling et al.
2020/0141065 A1 5/2020 Coots
2020/0393477 A1 12/2020 Davey et al.
2021/0084789 A1 3/2021 Kuo
2021/0087753 A1 3/2021 Sperling et al.
2021/0140511 A1 5/2021 Bonessio
2021/0234290 A1 7/2021 Dunham et al.
2022/0105380 A1 4/2022 Jones et al.

FOREIGN PATENT DOCUMENTS

CN 103797575 A 5/2014
CN 104838733 A 8/2015
CN 104969669 A 10/2015
CN 106921060 A 7/2017
CN 107112665 A 8/2017
CN 107112668 A 8/2017
CN 107206153 A 9/2017
CN 107683548 A 2/2018
CN 110419148 A 11/2019
CN 110741513 A 1/2020
CN 110970754 A 4/2020
CN 111095683 A 5/2020
CN 111453513 A 7/2020
CN 212315115 U 1/2021
CN 212342862 U 1/2021
CN 112460499 A 3/2021
CN 113226961 A 8/2021
CN 113316871 A 8/2021
CN 113526142 A 10/2021
DE 2048532 A1 10/1971
DE 3507967 A1 4/1986
DE 69233259 T2 8/2004
DE 102011112801 A1 3/2012
DE 112017004070 T5 5/2019
DE 202020105427 U1 1/2021
EP 2832194 B1 2/2015
EP 2832195 A1 2/2015
EP 2832196 A1 2/2015
EP 3027086 B1 6/2016
EP 3387694 A1 10/2018
JP 089129 B2 1/1996
JP 2503645 B2 4/1996
JP 5255253 B2 4/2013
JP 6457403 B2 12/2018
JP 2020513989 A 5/2020
JP 2022041011 A 3/2022
KR 101749921 B1 3/2012
KR 20120068664 A 6/2012
KR 102023307 B1 2/2013
KR 20140038938 A 3/2014
KR 20140146101 A 12/2014
KR 101529457 B1 6/2015
KR 20160020566 A 2/2016
KR 20180033234 A 4/2018
KR 102023312 B1 9/2019
KR 20200031872 A 3/2020
KR 20200048135 A 5/2020
KR 20200095470 A 8/2020
WO 1989000346 A1 1/1989
WO 2001074542 A1 10/2001
WO 2004047509 A1 6/2004
WO 2004106948 A1 12/2004
WO 2007123571 A1 11/2007
WO 2008147362 A1 12/2008
WO 2010080597 A1 7/2010
WO 2012138519 A2 10/2012
WO 2017164236 A1 9/2017
WO 2018211449 A1 11/2018
WO 2019067022 A1 4/2019
WO 2019182774 A1 9/2019
WO 2019204686 A1 10/2019
WO 2020131684 A1 6/2020
WO 2020181148 A1 9/2020

(56) References Cited

FOREIGN PATENT DOCUMENTS

| | | | |
|---|---|---|---|
| WO | 2021016460 | A1 | 1/2021 |
| WO | 2021025939 | A1 | 2/2021 |
| WO | 2021154823 | A1 | 8/2021 |

OTHER PUBLICATIONS

Written Opinion dated Aug. 9, 2019 issued in counterpart application No. PCT/US2019/028257, 5 pages.
GHz BGA Socket User Manual, Ironwood Electronics. 2017; Available from: https://www.ironwoodelectronics.com/catalog/Content/Drawings/SGB.pdf, pp. 15.
Timsit, R.S., High Speed Electronic Connector Design: A Review of Electrical and Electromagnetic Properties of Passive Contact Elements—Part 1 IEEE Transactions on Electronics, 2008. 91(8): p. 1178-1191.
Sable, S.K. and P. Gour. Dispersion Analysis of a Microstrip Line at Higher Frequencies by Using Sonnet and Matlab. in 2011 International Conference on Communication Systems and Network Technologies. 2011. IEEE., pp. 6.
Comparing Embedded Coplanar Waveguide and Stipline for Multi-Layer Boards. 2019; Available from: https://www.signalintegrityjournal.com/articles/1209-comparing-embedded-coplanar-waveguide-and-stipline-for-multi-layer-boards., pp. 8.
Alan D. Knight et al., "Surface-Soldered Pinless Module Connector", in IEEE Transactions on Components, Hybrids, and Manufacturing Technology, vol. 8, No. 4, pp. 535-540, Dec. 1985.
F. J. Guarin et al., "Contact Resistance Degradation in Z-Axis Connectors Operated at Burn-In Temperatures," Proceedings of IEEE 43rd Electronic Components and Technology Conference (ECTC '93), 1993, pp. 88-92.

* cited by examiner

SOLDERLESS CIRCUIT CONNECTOR

PRIORITY

This application is a Continuation of PCT/US2019/028257 filed with the U.S. Patent and Trademark Office on Apr. 19, 2019, and claims the benefit of U.S. Provisional Application No. 62/660,036 filed with the U.S. Patent and Trademark Office on Apr. 19, 2018, the entire contents of each of which is incorporated herein by reference.

BACKGROUND OF THE INVENTION

1. Field

The present invention relates generally to electrical connectors, more particularly to surface mount connectors allowing repeated mounting and unmounting of electronic components having a plurality of densely populated, pinless terminals.

2. Related Art

While the size of integrated circuit (IC) packages is decreasing, the number of circuits per package is increasing. Thus, the number of localized in extremely small spaces terminal leads necessary to communicate between the circuit elements and the outside system is increasing, which is why terminal leads are becoming finer, closer spaced, and more difficult to mount on PCBs.

In order to overcome the difficulty of mounting IC packages with multiple dense connections, the packaging technology has evolved from a through hole and surface mount packaging to a leadless packaging, such as ball grid array (BGA) and chip-scale packaging (CSP). As the use of BGAs and CSPs is limited to applications where high cost is a secondary consideration, a dual/quad flat no leads (DFN/QFN) packaging has emerged as a cost-efficient packaging technology. An increase in integration density as well as problems arising from cooling power IC has renewed the interest in superconductor ICs capable of operating with low energy consumption and much higher speed.

Interconnect technology is lagging behind package microminiaturization pace; therefore, connectors used to connect packages with PCBs are becoming the bulkiest, heaviest, and most expensive parts of electronic products. For example, BGA and CSP packages are placed within a mounting device designed to hold packages providing high interconnection density. The mounting device has electrical contacts the top part of which is aligned with contacts on the IC package and the bottom part is aligned with pads on the PCB where this device must be mounted. A disadvantage of interconnection technology is resistance between IC package contacts and contacts of the mounting device because of contact oxidation, especially when the IC is tested at a high temperature. BGA packages are vulnerable to stress because of flexural stress from the circuit board resulting in potential reliability issues. Surface irregularities on packages and mounting devices themselves can result in failure of certain electrical contacts. Another disadvantage of such an electrical connection is the difficulty to align package terminals with the mounting device contacts with extremely small dimensional and physical tolerance. Still another disadvantage is the cost of package materials, which makes BGA and CSP packages undesirable due to their expensive substrate cost.

U.S. Pat. No. 6,350,138 discloses a socket for removable mounting electronic parts that has a plurality of conductive terminals such as BGA packages. All contact members of the disclosed socket have a pair of arm-like contact parts capable of elastically opening or closing to hold or release IC's terminals. The elastic contact parts can perform a wiping action to remove the oxide layer from the package terminal and increase dimensional tolerance. However, due to the size and orientation of the contact parts, the disclosed socket introduces parasitic resistive, capacitive, and inductive circuit components, when it is being operated at high frequencies, thus, degrading signal propagation.

Solder reflow that is a common interconnection technology requires subjecting both the IC package and the PCB to high heat. Overheating or thermal stress can destroy or weaken ICs, resulting in higher initial and long-term failure rates. To remove and replace a defective IC, the entire PCB should be subjected to elevated temperatures, which results in additional thermal stress. To remove DFN/QFN packages, a PCB should be baked for four hours to reduce the risk of delaminating either the PCB or the IC. See, Microchip, Package Application Note for QFN and DFN Packages, AN2089 (2016). Unlike the BGA interconnection, the solder IC package and the PCB interconnection allow for decreased height of the connector and mount. However, the use of solder reflow technology requires purchase and maintenance of expensive machinery, and the use a limited number of chemical and physically compatible materials in solder reflow narrows the number of designs where solder reflow can be applied.

U.S. Pat. No. 4,427,249 discloses a connector containing housing, cover, and multiple beryllium copper contact elements with a pin extended to the housing and a C-shaped section with a contact surface located on the free end of the section's upper limb. The upper limb serves as a cantilever beam that provides spring force to the contact surface; and the lower limb with the pin supports contact elements in the housing. The four side walls of the housing with equally elevated steps extending along the wall's outer and inside surfaces provide the IC package-receiving compartment. Walls also have horizontal cuts that extend as grooves across the step edges and are used to load contact elements. The disclosed connector enables the installation and the replacement of IC packages to increase contact elements' dimensional and physical tolerance, improve the connection reliability due to a wiping action, and decrease high-frequency signal distortions due to the connector's low height. However, besides the decreased contact elements' height, the total connector's height includes the height of its pins, which also contributes to high frequency signal degradation. The connector's design complexity increases the cost and the difficulty of manufacturing its housing. The loading of contact elements into a housing of such type requires expensive and time-consuming manual work causing the connector's high cost. Beryllium copper does not demonstrate superconductor properties in cryogenic applications; therefore, the connector's contact elements are incapable of effectively removing heat.

U.S. Pat. No. 5,738,530 discloses a connector having a plurality of electrically conductive metal traces on a flexible dielectric substrate and a plurality of protuberant electrical contacts, made of electrically conductive elastomer, that project from the trace ends to resiliently engage a contact site of the device to which the connector is coupled. This connector does not introduce additional signal distortions because of its low height; it is effective and reliable in operation because it does not require strict dimensional tolerance. However, it is difficult, time-consuming, and costly to manufacture.

Accordingly, drawbacks of conventional systems and methods include one or more of degraded signal propagation, soldering/unsoldering components, and excess heat retention in contact elements.

SUMMARY

To overcome shortcomings of conventional methods, components and systems, provided herein is a multi-use mechanical integrated circuit connector for releasably securing electrical connectors without solder that provides at least one of a micro-strip, strip-line or waveguide with enhanced signal propagation, as well as the advantages described herein.

An aspect of the present invention provides a multi-use device for solderless, repeatable electrical connection with an IC package or chip, the device including a top including a first side and a second side, with the first and second sides facing substantially opposite directions; an alignment plate including a first side and a second side, with the first and second sides facing substantially opposite directions; a connector including a hole, a first side, a second side, and at least one edge, with the first and second sides facing substantially opposite directions and the at least one edge being positioned between the first and second sides and extending along the hole; and a bottom including a first side and a second side, with the first and second sides facing substantially opposite directions. The second side of the top faces the first side of the alignment plate, the second side of the alignment plate faces the first side of the connector, the second side of the connector faces the first side of the bottom, and the top moves toward the bottom to secure the IC adjacent to the at least one edge of the connector.

Another aspect of the present disclosure provides a device for releasably securing an electrical device, the device including a top, an alignment plate, a connector, a bottom, and a plurality of rails that align the top and the connector. At least one post of a plurality of posts is also provided to align the alignment plate, the connector, and the bottom. The top is stacked on the alignment plate, the alignment plate is stacked on the connector, and the connector is stacked on the bottom. The top is moveable in a first direction along the plurality of rails.

Still another aspect of the present disclosure is that the connector comprises at least one layer of conductors extending from the edges of the connector.

BRIEF DESCRIPTION OF THE DRAWINGS

The above and other aspects, features and advantages of certain embodiments of the present invention will be more apparent from the following detailed description taken in conjunction with the accompanying drawings, in which.

DETAILED DESCRIPTION

The following detailed description of certain embodiments references the accompanying drawings. In the description, explanation about related functions or constructions known in the art are omitted for clarity.

Figure 1A:
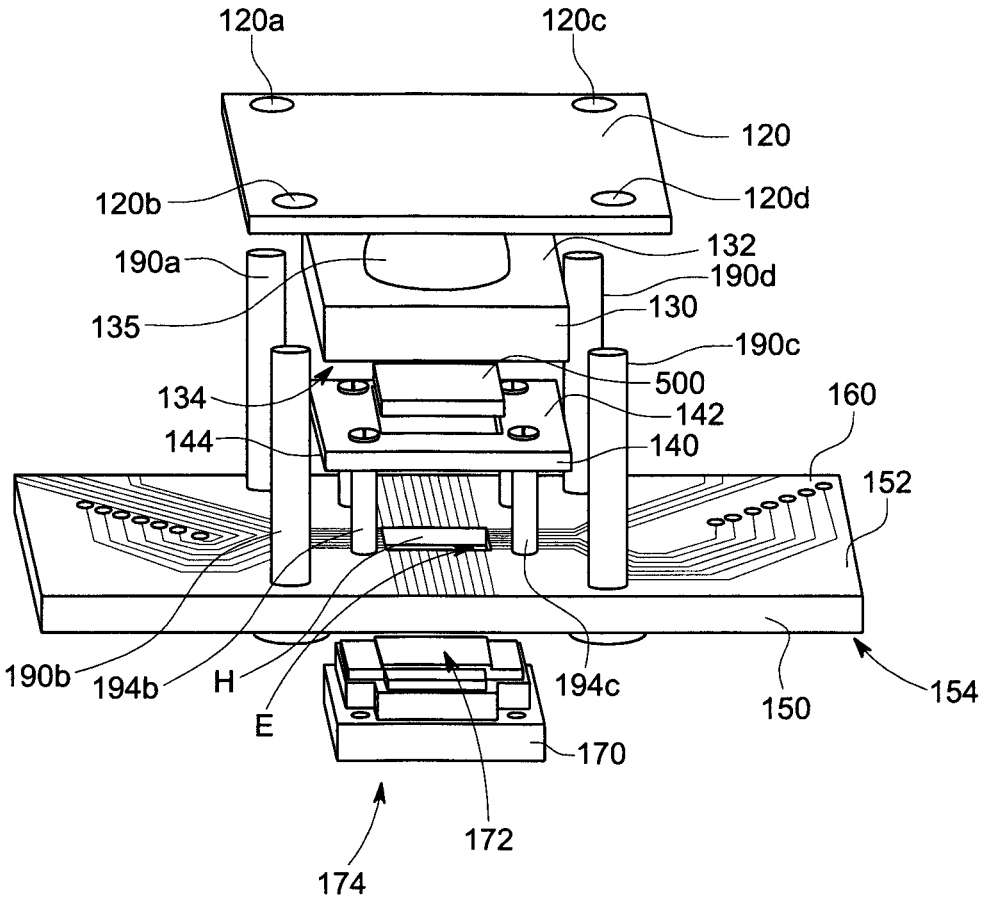
FIG. 1*a* is an exploded perspective view illustrating a device in accordance with an embodiment of the present disclosure.

FIG. 1*a* is an exploded perspective view of a device in accordance with an embodiment of the present disclosure.

As shown in FIG. 1*a*, the device includes a spring plate 120, a top 130, an alignment plate 140, connector 150, and a bottom 170, stacked in a first direction. The spring plate 120 includes holes 120*a-d* in respective corners thereof. The top 130 includes a first side 132 and a second side 134, with the first side 132 and the second side 134 facing substantially opposite directions. The first side 132 includes a hemisphere 135 centrally located thereon. The alignment plate 140 includes a first side 142 and a second side 144 that also face in substantially opposite directions. The connector 150 includes a first side 152, a second side 154, a hole H, and at least one edge E. The first side 152 and the second side 154 also face in substantially opposite directions and at least one edge E is positioned between the first side 152 and the second side 154. The bottom 170 includes a first side 172 and a second side 174 that face in substantially opposite directions. As shown in FIG. 1*a*, the second side 134 of the top 130 faces the first side 142 of the alignment plate 140, the second side 144 of the alignment plate 140 faces the first side 152 of the connector 150, and the second side 154 of the connector 150 faces the first side 172 of the bottom 170.

The top 130 is movable toward the bottom 170 to secure the integrated circuit 500 to the connector 150. The top 130 and bottom 170 are configured to apply a force (F, FIGS. 7 to 8) therebetween to secure the chip 500 and provide an enhanced electrical connection between the connector 150 and chip 500, for solderless, repeatable electrical connection therebetween.

Figure 1B:
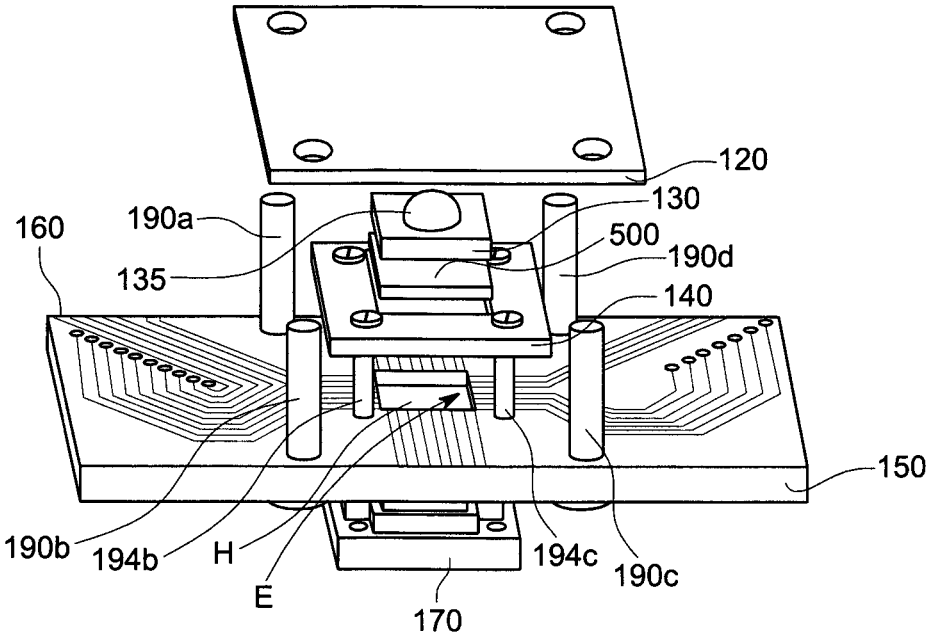
FIG. 1*b* is a perspective view illustrating a device in accordance with an embodiment of the present disclosure.

FIG. 1*b* is an exploded perspective view illustrating a device in accordance with an embodiment of the present disclosure. FIG. 1*b* shows a top 130 having horizontal dimensions matching the horizontal dimensions of the chip 500.

Figure 2:
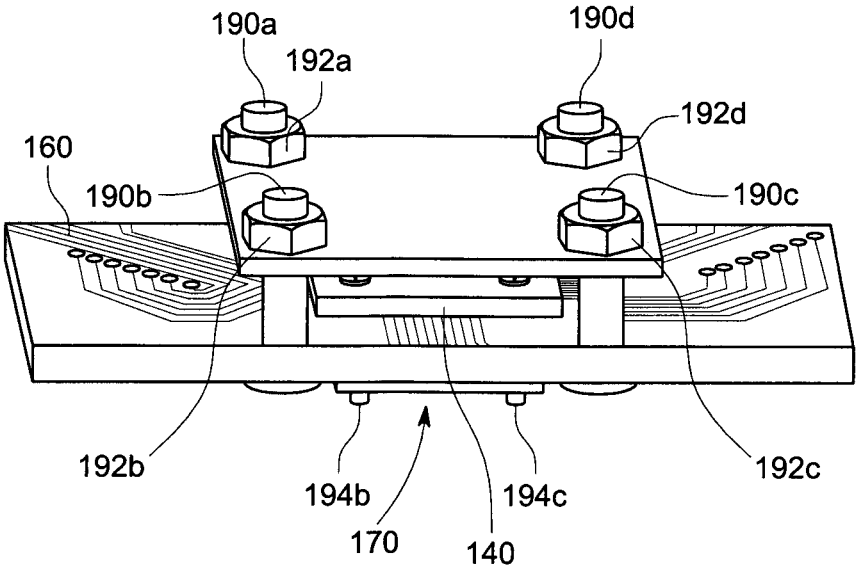
FIG. 2 is an exploded perspective view illustrating the assembled device of FIG. 1*a;*

FIG. 2 is a perspective view illustrating the assembled device of FIG. 1*a*.

As shown in FIG. 2, the spring plate 120 is square shaped and is formed of a resilient material, e.g., a 16×16 mm spring plate made from 0.79 mm thick epoxy glass laminate (G10/FR4). As shown in FIGS. 1*a* and 1*b*, a hole is provided in each corner thereof for a respective free-fit bolt, i.e., a rail of a plurality of rails 190*a-d*, to pass through.

The spring plate 120, top 130, alignment plate 140, connector 150 and bottom 170 are stacked in the first direction. As shown in FIG. 2, the spring plate 120 is stacked on the first side 132 of the top 130, and the spring plate 120 moves in the first direction along a plurality of rails 190, e.g., by user tightening of screws 192*a-d* (FIG. 2) on respective ends of the plurality of rails 190*a-d*. The plurality of rails 190 can be provided as free-fit bolts and the like.

The plurality of rails 190*a-d* facilitate uniform movement of the top 130 towards and away from the connector 150 and the bottom 170. As shown in FIGS. 1*a* and 1*b*, the hemisphere 135 is provided on the first side 132 of the top 130 to direct the point of application of the force F and prevent damage to the chip 500.

Figure 3:
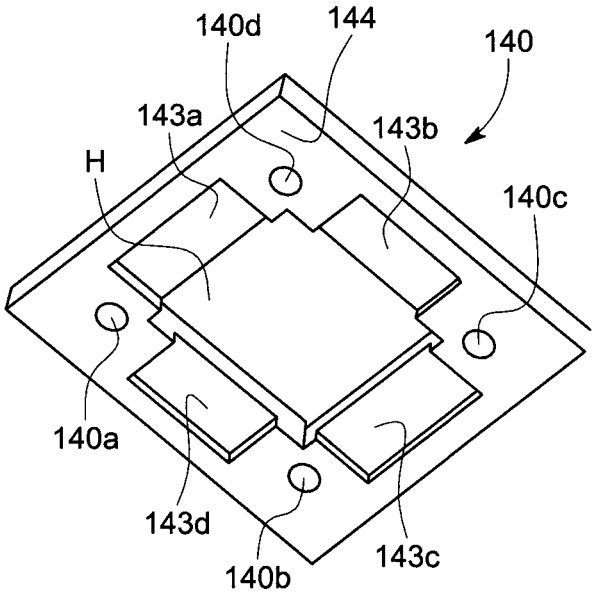
FIG. 3 is a perspective view illustrating the underside of the alignment plate of the device in accordance with an embodiment of the present disclosure.

FIG. 3 is a perspective view illustrating the underside, i.e., second side 142, of the alignment plate 140 of the device in accordance with an embodiment of the present disclosure.

The alignment plate 140 is preferably made from epoxy glass laminate with a square hole H for a close-fit clearance with edges of a chip 500 located in the hole H, when mounted in the device. Holes 140*a-d* are provided in respective corners of the alignment plate 140. Cut-outs 143*a-d* are provided on respective sides of hole H on a bottom surface, i.e., second side 144, of the alignment plate 140, with the cut-outs 143*a-d* forming a cross-shape.

Figure 4:
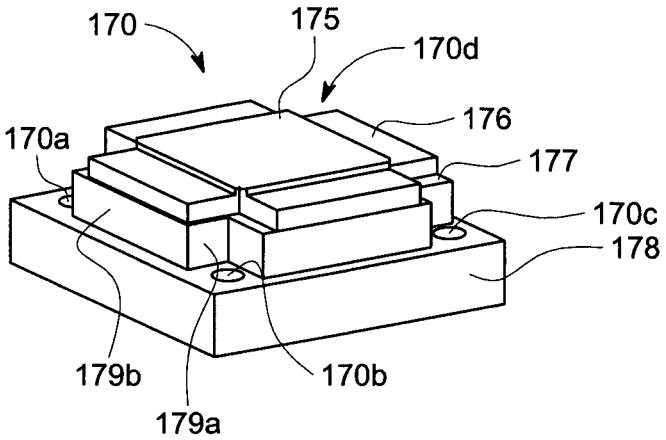
FIG. 4 is a perspective view illustrating a bottom of the device in accordance with an embodiment of the present disclosure.

FIG. 4 is a perspective view illustrating the bottom 170 of the device in accordance with an embodiment of the present disclosure.

As shown in FIG. 4, the bottom 170 is shaped as a step pyramid with a plurality of steps uniformly provided on each side of the 170, with the bottom 170 cut from epoxy glass laminate.

Figure 6:
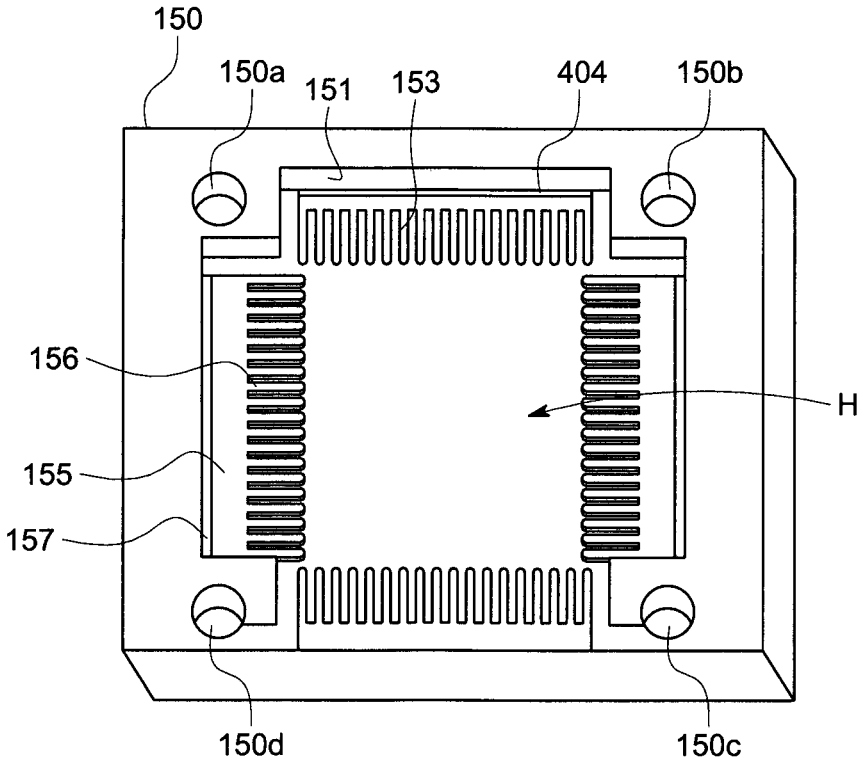
FIG. 6 illustrates an underside of the connector of the device in accordance with an embodiment of the present disclosure.

As shown in FIG. 4, each side of the bottom 170 contains four steps, each having a different height, i.e., a supporting step 175, an active step 176, an alignment step 177, and a bumper step 178. Edges of the supporting steps 175 support one or more of a plurality of fingers 156 provided on the connector. (FIG. 6.) Fingers 156 support respective conductors. Edges of the active steps 176 are positioned under edges of palms 155.

Figure 7:
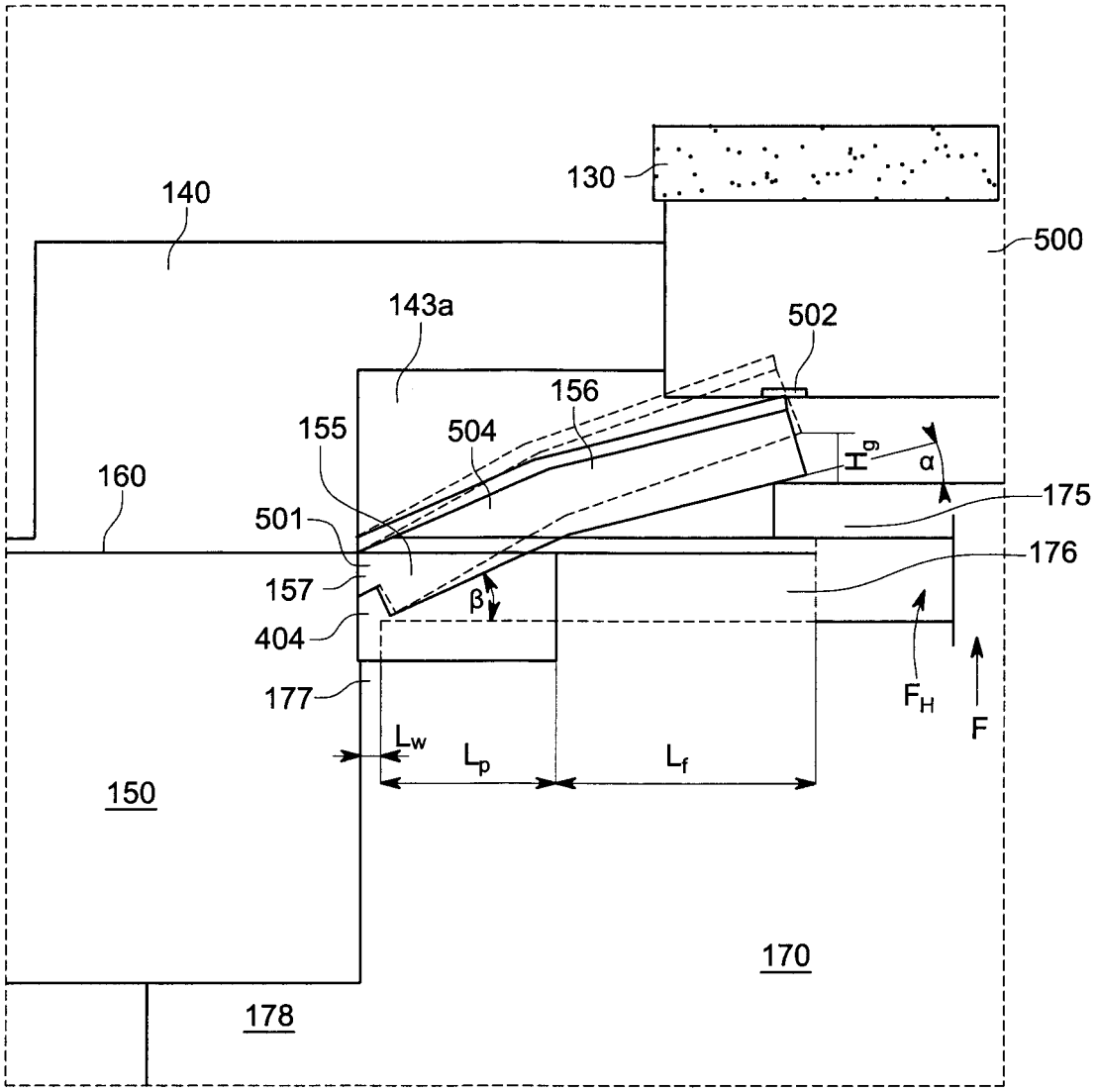
FIG. 7 is a profile view illustrating an alignment plate, connector and bottom of the device contacting a surface mounted chip being mechanically retained by the device, in accordance with another embodiment of the present disclosure.

Edges of the alignment steps 177 are positioned beneath rotation axes 501 (FIG. 7). The bumper steps 178 are preferably at least 0.5 mm wide, and edges of the bumper steps 178 are wider than respective edges of the cut-off 151 of the connector 150. (FIG. 6.)

Figure 5:
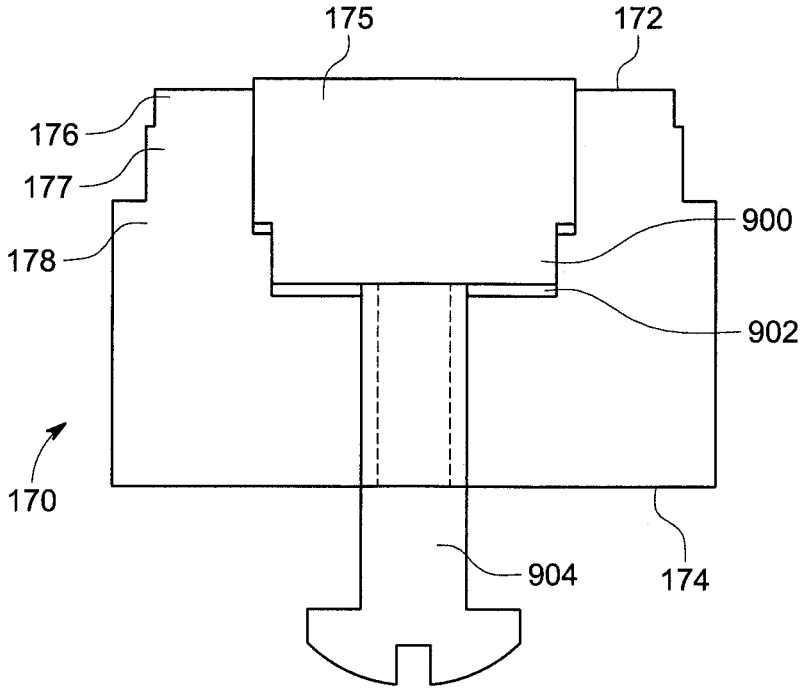
FIG. 5 is a cut-away profile view illustrating an adjuster of the device in accordance with an embodiment of the present disclosure.

FIG. 5 is a cut-away profile view illustrating an adjuster 904 of the device in accordance with an embodiment of the present disclosure.

As shown in FIG. 5, the adjuster 904, which can be provided as a screw, modifies the distance 902 by which the supporting step 175 protrudes from the active step 176 in the first direction, thereby changing a height of the supporting step 175 and changing a location where the conductor on the finger 156 will contact a corresponding pad of the chip 500.

FIG. 6 illustrates an underside of the connector 150 of the device in accordance with an embodiment of the present disclosure.

The connector 150 is preferably formed as a portion of a printed circuit board (PCB), e.g., a standard 1.6 mm-thick FR4 double-sided PCB. As shown in FIG. 6, various portions are provided for mounting connectors of various kinds of IC packages, i.e. chip 500, that are to be connected, thereby providing a solderless, repeatable electrical connection between the chip 500 and the connector 150.

As shown in FIG. 6, a hole 150*a-d* is provided in each respective corner, in a corresponding position as holes 140*a-d* and 170*a-d* in the alignment plate 140 and bottom 170, for securing each of the alignment plate 140, connector 150, and the bottom 170 by passing posts 194*a-d* therethrough.

The connector 150 includes a plurality of circuit traces 160 (FIGS. 1*a*-2), i.e., electrically conductive metal traces or conductors, and the density of circuit traces 160 increases as the traces 160 extend toward the hole H in which the chip is secured in the device, with the alignment plate 140 and connector 150 receiving the chip 500, which has a plurality of contact pads positioned on peripheries thereof.

The axes of the circuit traces 160 that are routed under the chip 500 and the axes of pads 502 (FIGS. 7 to 8) of the chip 500 are collinear and have the same pitch, and the pads 502 are equal to or wider than traces 160. Accordingly, the connector 150 includes distal ends of the circuit traces 160 that extend from the at least one edge (E) to electrically connect with corresponding pads 502 of the chip 500 mounted in the device.

The underside of the connector 150 includes a cross-shaped cut-off 151, preferably 1.25 to 1.30 mm deep, that surrounds the hole H of the alignment plate 140. Respective distal ends of the circuit traces 160 are provided on respective fingers 156 that extend into the hole H. Cuts 153 separate the fingers 156. Traces 111 located on wrists 157, palms 155, and fingers 156 serve as contacts rotatable around the rotation axes 501 at angle β for palms 155 and rotation axes 504 angle α for fingers 156.

FIG. 7 is a profile view illustrating the alignment plate 140, connector 150 and bottom 170 of the device contacting a surface mounted chip 500 that is being mechanically retained by the device, in accordance with an embodiment of the present disclosure. A cut slot may be provided in a direction perpendicular to the first direction, with the cut slot removing a predefined amount of material removed from a side of the PCB opposite the side on which the circuit trace 160 is provided. Lengths $L_w$, $L_p$ and $L_f$ depend on the position of the axis 501 and the inclination angles β of palms 155 and a of fingers 156 in the respective operating state and also depend on the selected PCB material. As understood by those skilled in the art, edges of some fingers 156, if formed from an inhomogeneous material as FR4, may fracture if the finger 156 has a height $F_H$ less than 0.25 mm.

As shown in FIG. 7, when the force F is applied, the top 130 moves downward in the first direction towards the bottom 180, the chip 500 is secured in the alignment plate 140, and the wrist 157 and fingers 156 are deflected upward, with the edge of the supporting step securing the distal end of the circuit trace 160 against a corresponding pad of the chip 500.

Figure 8:
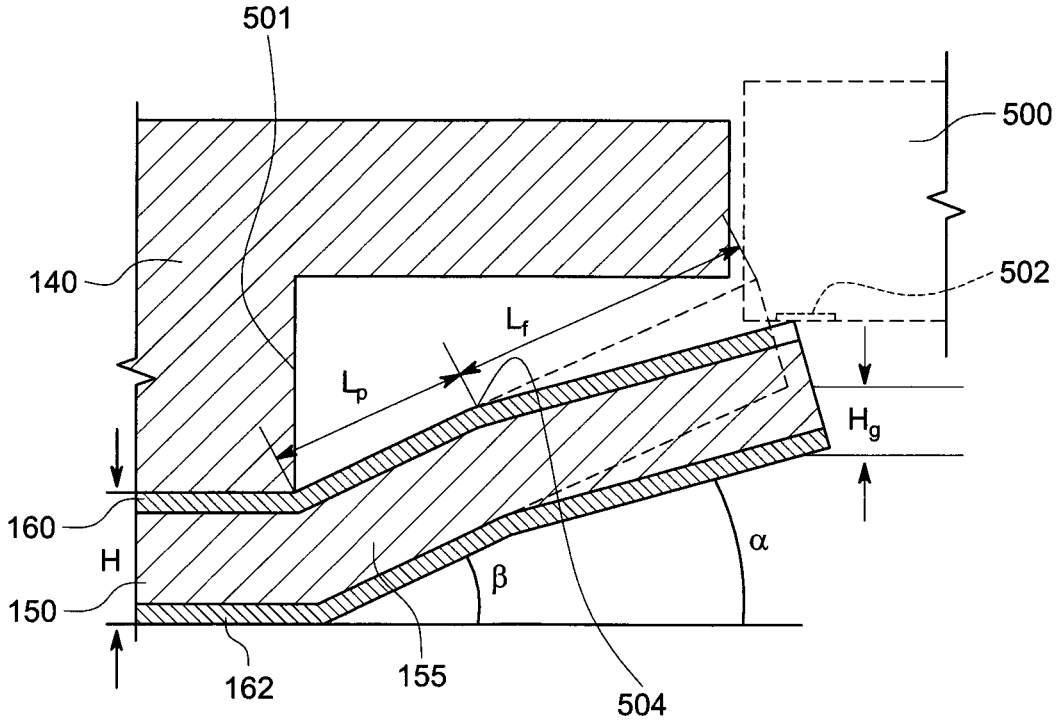
FIG. 8 is a profile view illustrating an alignment plate and connector of the device contacting a surface mounted chip being mechanically retained by the device, in accordance with another embodiment of the present disclosure.

FIG. 8 is a profile view illustrating the alignment plate 140 and connector 150 of the device contacting a surface mounted chip 500 that is mechanically retained by the device, in accordance with another embodiment of the present disclosure.

As shown in FIG. 8, the PCB is reinforced by providing a circuit trace on either side thereof, rather than provide a cut slot. For clarity, FIG. 8 does not show each of the supporting step, active step, alignment step or bumper step that support and exert an opposing force on the palms 155 and fingers 156, as disclosed above. In this embodiment, the connector 150 is formed as a portion of double layer PCB. Top conductive layer 160 and grounded bottom layer form a microstrip adjacent to the pad 502 of the chip 500.

Figure 9:
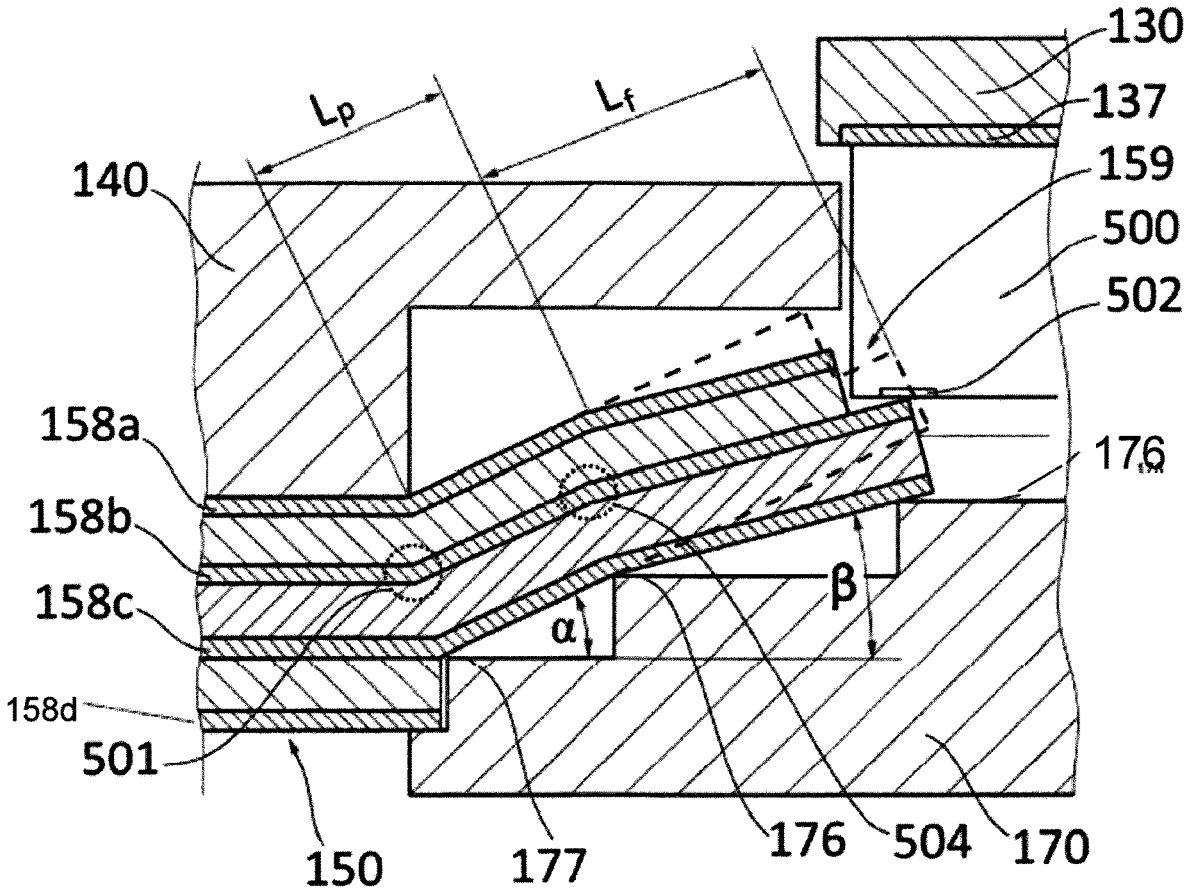
FIG. 9 is a profile view illustrating a connector of the device contacting a surface mounted chip being mechanically retained by the device, in accordance with another embodiment of the present disclosure.

FIG. 9 is a profile view illustrating the top 130, the alignment plate 140, the connector 150, and the bottom 170 in accordance with an embodiment of the present disclosure working with a superconductor chip 500.

As shown in FIG. 9, the second side of the top 130 is provided with 0.3 mm deep and 5 mm wide cut-off 159 used for installing a heatsink 137, preferably a copper braid sleeve with one end pressed between the top 130 and the chip 500, with another end thermally connected to a second stage of a cryocooler. The connector 150 is formed as a portion of multilayer PCB with conductive layers 158*a-d*. Signal layer 158*c* along with grounded layers 158*a* and 158*c* form a stripline adjacent to the pad 502 of the chip 500. The cut-off 159 bifurcates upper grounded layer 158*a* and an upper inner core between layers 158*a* and 158*b* in close proximity to all edges E, thereby providing a direct connection between the chip 500 and PCB striplines.

FIGS. 8 and 9 demonstrate that the connector 500 can be readily transformed into a microstrip or a stripline connector providing a perfect match of the chip's and the connector's impedances to avoid signal distortion. Matching the connector's impedance to that of the chip is complicated due to mechanical limitations of existing connectors and limitations in material features of existing connectors. The impedance of the new connector can be controlled as easily as that of a PCB by varying the width and spacing of PCB traces over the distance.

Unlike a typical spring connector's contact, which can be represented as a simple cantilever beam whose one end is supported by clamping and the other end is subjected to one concentrated load by the chip, the new connector's contact can be represented as a cantilever supported by an additional load by the bottom 170. Such a cantilever is capable of providing a higher contact normal force from the stored energy than a cantilever supported by one load if these cantilevers' edges are deflected by the same distance, e.g., similar to a diving board extended over the edge of a swimming pool. As a result, the new connector allows designers to establish an acceptable contact resistance between the connector's contact and chip's pads using a lower height of the connector that will improve operation characteristics at high frequencies.

Traces 160 (FIGS. 7 and 8) and 158*a-d* (FIG. 9) of the connector 150 which is working with superconductor chip 500 are preferably formed from copper. As superconductor chips have extremely low power consumption, the Joule heat power that generated by electric currents flowing through junctions between resilient contacts of existing connector's conductors and chip pads, as well as the heat generated in conductors themselves, may become comparable with the chip heat generation. The electrical and thermal resistance of copper traces approaches zero at cryogenic temperatures, thus, copper traces do not contribute to heat generation. Instead, they can serve as a perfect heatsink for heat power generated in their junctions with chip pads. Grounded layers 158*a* and 158*c* (FIG. 9) and 160 (FIGS. 7 and 8) should be provided with thermo-links, e.g., copper braid sleeve, having one end soldered to the grounded layer and the other end tightly connected with the last stage of the cryocooler.

While the present disclosure has been shown and described with reference to certain aspects thereof, it will be understood by those skilled in the art that various changes in form and details may be made therein without departing from the spirit and scope of the present disclosure, as defined by the appended claims and equivalents thereof

What is claimed is:

1. A device for solderless, repeatable electrical connection with an integrated circuit, the device comprising:

a top comprising a first side and a second side, wherein the first side and the second side face substantially opposite directions;

an alignment plate comprising a first side and a second side, wherein the first side and the second side face substantially opposite directions;

a connector comprising a hole, a first side, a second side, and at least one edge, wherein the first side and the second side face substantially opposite directions and the at least one edge is positioned between the first side and the second side and extends along the hole; and a bottom comprising a first side and a second side, wherein the first side and the second side face substantially opposite directions, wherein the second side of the top faces the first side of the alignment plate, wherein the second side of the alignment plate faces the first side of the connector, wherein the second side of the connector faces the first side of the bottom, wherein the top is configured to move toward the bottom to secure the integrated circuit adjacent to the at least one edge of the connector, wherein the connector comprises a printed circuit board (PCB), with a plurality of traces extending from the at least one edge of the connector along at least one PCB layer, and wherein at least one trace of the plurality of traces in adjacent PCB layers forms a waveguide.

2. The device of claim 1, further comprising a plurality of rails configured for the top to move toward and away from the bottom.

3. The device of claim 2, further comprising a spring plate configured to exert a force pressing on the top to move the top along plurality of rails toward the bottom.

4. The device of claim 3, wherein the top further comprises a hemisphere configured to receive the pressing force.

5. The device of claim 1, further comprising a plurality of conductors provided on a plurality of parallel cuts in the PCB.

6. The device of claim 5, further comprising at least one grounded PCB layer provided with a heatsink.

7. The device of claim 5, wherein, with the integrated circuit unloaded from the device, each distal end of the plurality of conductors extends from the at least one edge in a first direction substantially perpendicular to the first side of the connector.

8. The device of claim 5, wherein, with the integrated circuit secured in the device, each distal end of the plurality of conductors is deformed toward a second direction substantially perpendicular to the first direction.

9. The device of claim 1, wherein the waveguide is one of a microstrip and a stripline.

10. A device comprising:

a top;

an alignment plate;

a connector;

a bottom; and a plurality of rails configured to align a spring plate and the connector; and a plurality of posts configured to align the alignment plate, the connector and the bottom, wherein the top is configured to stack on the alignment plate, the alignment plate is configured to stack on the connector, and the connector is configured to stack on the bottom, wherein the top is moveable in a first direction along the plurality of rails, wherein the bottom comprises a supporting step, an active step, an alignment step and a bumper step, each having a different height in the first direction.

11. The device of claim 10, wherein the supporting step, the active step and the alignment step are arranged in a pyramid shape in the first direction.

12. The device of claim 10, wherein an integrated circuit is secured in a hole adjacent to at least one edge of the connector by moving the top in the first direction toward the connector.

13. The device of claim 12, wherein the alignment plate is configured to align the integrated circuit adjacent to the at least one edge.

14. The device of claim 10, wherein the connector further comprises a plurality of conductors extending in a second direction substantially perpendicular to the first direction.

15. The device of claim 14, wherein the connector comprises a printed circuit board (PCB) with a plurality of traces on at least one layer of the PCB.

16. The device of claim 15, wherein traces in adjacent PCB layers form at least one waveguide.

17. The device of claim 14, wherein at least one edge of the supporting step is configured to support a first part of the each of the plurality of conductors extending from the at least one edge.

18. The device of claim 14, wherein at least one edge of the active step is configured to support a second part of conductors of the plurality of conductors extending from the at least one edge.

19. The device of claim 10, wherein the active step, the alignment step and the bumper step are arranged in a pyramid shape in the first direction.

20. The device of claim 10, further comprising an adjuster configured to change a distance that the supporting step protrudes from the active step in the first direction.

* * * * *